US010102799B2

(12) United States Patent
Wu et al.

(10) Patent No.: US 10,102,799 B2
(45) Date of Patent: Oct. 16, 2018

(54) ORGANIC LIGHT EMITTING DISPLAY PANELS AND DRIVING METHODS THEREOF

(71) Applicants: Shanghai Tianma AM-OLED Co., Ltd., Shanghai (CN); Tianma Micro-electronics Co., Ltd., Shenzhen (CN)

(72) Inventors: Tong Wu, Shanghai (CN); Wenhui Zou, Shanghai (CN); Dong Qian, Shanghai (CN); Yue Li, Shanghai (CN); Gang Liu, Shanghai (CN); Dongxu Xiang, Shanghai (CN); Renyuan Zhu, Shanghai (CN)

(73) Assignees: Shanghai Tianma AM-OLED Co., Ltd., Shanghai (CN); Tianma Micro-electronics Co., Ltd., Shenzhen (CN)

( * ) Notice: Subject to any disclaimer, the term of this patent is extended or adjusted under 35 U.S.C. 154(b) by 0 days.

(21) Appl. No.: 15/356,902

(22) Filed: Nov. 21, 2016

(65) Prior Publication Data

US 2017/0069262 A1 Mar. 9, 2017

(51) Int. Cl.
*G09G 3/3225* (2016.01)

(52) U.S. Cl.
CPC ... *G09G 3/3225* (2013.01); *G09G 2300/0408* (2013.01); *G09G 2310/0205* (2013.01); *G09G 2310/0216* (2013.01); *G09G 2310/0264* (2013.01)

(58) Field of Classification Search
CPC ..... G09G 3/3225; G09G 2310/0205; G09G 2310/0264; G09G 2300/0408
See application file for complete search history.

(56) References Cited

U.S. PATENT DOCUMENTS 8,054,298 B2 * 11/2011 Asano ..... G09G 3/3233 345/173
8,907,881 B2 * 12/2014 Koyama ..... G02F 1/13452 345/211

(Continued)

FOREIGN PATENT DOCUMENTS

CN 101826300 A 9/2010
CN 104050916 A 9/2014

(Continued)

*Primary Examiner* — Mihir K Rayan
(74) *Attorney, Agent, or Firm* — Anova Law Group, PLLC

(57) ABSTRACT

The description provides an organic light emitting display panel and a driving method thereof, characterized in that the organic light emitting display panel is divided into a display area and a non-display area, and the non-display area surrounds the display area; the display area includes a plurality of rows of pixel units, and each row of pixel units include a plurality of pixel circuits; a plurality of driving circuit units located in the non-display area; and any one of the driving circuit units is electrically connected to more than two rows of the pixel units simultaneously. Using the organic light emitting display panel and the driving method thereof provided by at least one embodiment of the invention can be more advantageous to narrow borders on the basis of ensuring resolution and avoiding abnormal display of images.

14 Claims, 5 Drawing Sheets

(56) References Cited

U.S. PATENT DOCUMENTS

| | | | | |
|---|---|---|---|---|
| 2005/0264500 | A1* | 12/2005 | Shirasaki | G11C 27/028 345/77 |
| 2007/0124633 | A1* | 5/2007 | Kim | G09G 3/2003 714/726 |
| 2008/0030443 | A1* | 2/2008 | Yamashita | G09G 3/3233 345/84 |
| 2009/0034759 | A1* | 2/2009 | Ko | H04N 5/642 381/152 |
| 2009/0244055 | A1* | 10/2009 | Asano | G09G 3/3233 345/214 |
| 2010/0220093 | A1 | 9/2010 | Choi | |
| 2012/0105396 | A1* | 5/2012 | Sakamoto | G09G 3/3677 345/204 |
| 2012/0169799 | A1* | 7/2012 | Ono | G09G 3/3233 345/690 |
| 2013/0181969 | A1* | 7/2013 | Kishi | G09G 3/3233 345/212 |
| 2014/0111410 | A1 | 4/2014 | Guo | |
| 2015/0243208 | A1* | 8/2015 | Kim | G09G 3/2022 345/204 |

FOREIGN PATENT DOCUMENTS

| | | | |
|---|---|---|---|
| CN | 104200771 | A | 12/2014 |
| CN | 104934459 | A | 9/2015 |

* cited by examiner

ORGANIC LIGHT EMITTING DISPLAY PANELS AND DRIVING METHODS THEREOF

CROSS-REFERENCES TO RELATED APPLICATIONS

This application claims priority of Chinese Patent Application No. 201610304106.X, filed on May 10, 2016, the entire contents of which are hereby incorporated by reference.

FIELD OF THE INVENTION

The present disclosure generally relates to the field of display technology and, more particularly, relates to an organic light emitting display panel and a driving method thereof.

BACKGROUND

An organic light emitting diode (OLED) display panel generally comprises a pixel circuit located in a display area and a driving circuit located in a peripheral non-display area, wherein the driving circuit is responsible for providing various types of signals for the pixel circuit to control the pixel circuit to display an image.

In the prior art, the driving process of the pixel circuit typically includes an initialization stage, threshold compensation, a data writing stage and a light emitting stage, in such case, each pixel driving circuit generally requires the driving circuit to provide at least three kinds of signals with different waveforms, which also requires each pixel driving circuit to comprise at least three transmission lines for transmitting the three kinds of signals with different waveforms, with the continuous improvement of the display resolution, in order to drive the high PPI (pixel per inch) pixel circuit, the peripheral driving circuit will become more and more complicated, thus increasing the difficulty of design, and also being adverse to the design of the display device with narrow border. Moreover, scanning time for any stage of the initialization stage, the threshold compensation, the data writing stage and the light emitting stage cannot be reduced since the scanning time for each row of pixel circuits in a frame time is fixed, and with the continuous improvement of display resolution, it is hard for similar timing circuits to well drive a row of pixel circuits which results in nonuniform display as well as obvious display difference, such as the phenomenon of screen splitting.

BRIEF SUMMARY OF THE DISCLOSURE

For this purpose, one aspect of the present invention provides an organic light emitting display panel, characterized in that the organic light emitting display panel is divided into a display area and a non-display area, and the non-display area surrounds the display area, the display area includes a plurality of rows of pixel units, each row of the pixel units includes a plurality of pixel circuits, a plurality of driving circuit units located in the non-display area, any one of the driving circuit units is electrically connected to more than two rows of the pixel units simultaneously.

Another aspect of the present invention provides a driving method for the organic light emitting display panel as described above, characterized in that driving of any one of the pixel circuits at least includes processes of initialization, threshold compensation, data writing and light emitting, and the data writing is carried out successively after more than two rows of the pixel units are simultaneously subjected to the initialization and/or the threshold compensation.

Another aspect of the present invention provides a driving method for the organic light emitting display panel as described above, characterized in that first, the first scanning signal output circuits and/or the light emitting signal output circuits simultaneously transmit the first scanning signals to more than two rows of the pixel units in one-to-one correspondence, and then more than two of the second scanning signal output circuits successively transmit the second scanning signals to the more than two rows of the pixel units.

Another aspect of the present invention provides an organic light emitting display device comprising the organic light emitting display panel described above.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Specific embodiments are specially illustrated as below in order to explain the technical contents of at least one embodiment of the present invention in further detail in collaboration with the appended diagrams, but the following accompanying drawings and the detailed embodiments are not intended to limit at least one described embodiment of the present invention. Those of ordinary skill in the art can make some changes and modifications without departing from the spirit and scope of at least one embodiment of the present invention. Consequently, the protection scope of described embodiments of the present invention shall be defined by the claims.

Figure 1:
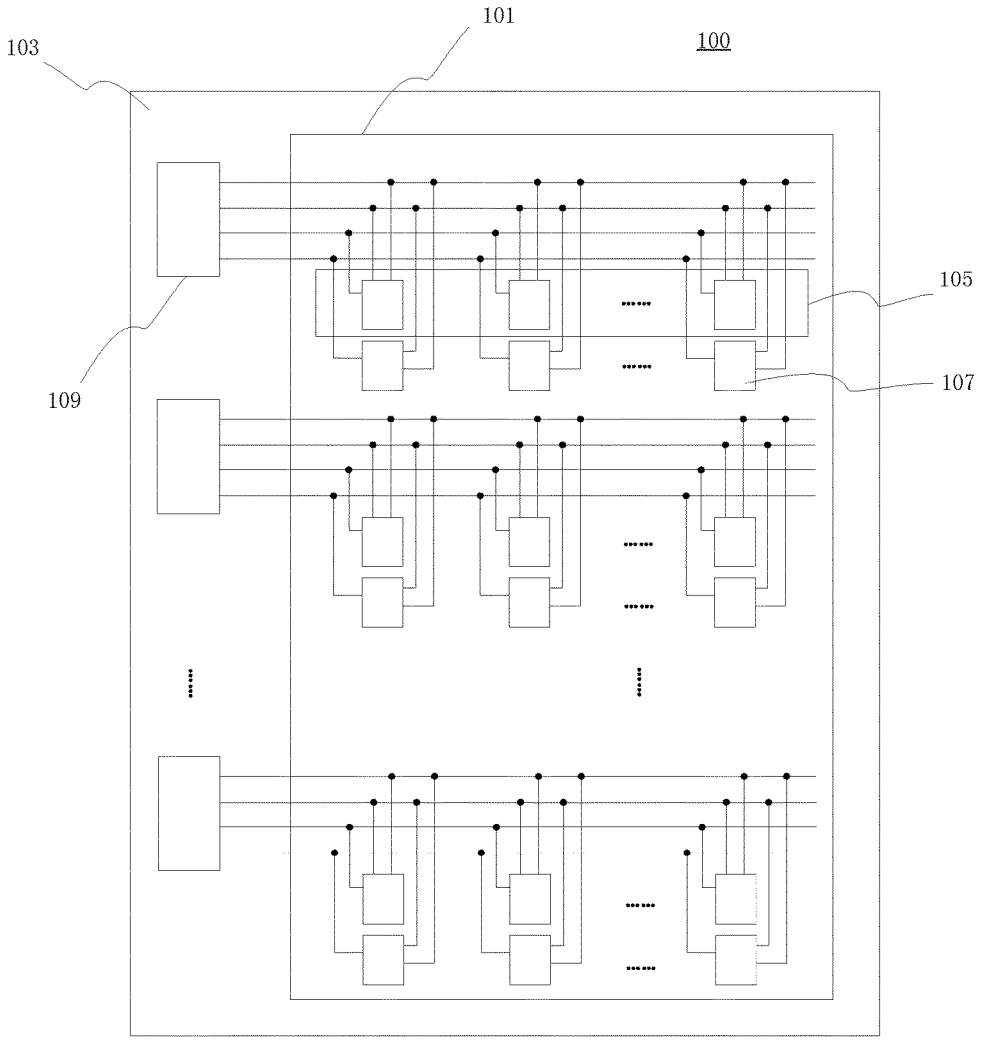
FIG. 1 depicts an exemplary organic light emitting display panel consistent with disclosed embodiments.

FIG. 1 depicts an exemplary organic light emitting display panel consistent with disclosed embodiments, wherein the organic light emitting display panel 100 comprises a display area 101 and a non-display area 103, and the non-display area 103 surrounds the display area 101. The display area 101 comprises a plurality of rows of pixel units 105, wherein each row of the pixel units 105 comprises a plurality of pixel circuits 107, the specific structure of the pixel circuits 107 is not defined herein, and the pixel circuits 107 can be formed by arbitrary number of transistors, capacitors and light emitting diodes through electric connection with one another, such as, for the simplest form, being formed by two transistors, one capacitor and one light emitting diode.

The non-display area 103 comprises a plurality of driving circuit units 109, wherein any one of the driving circuit units 109 is electrically connected to more than two rows of pixel units 105 simultaneously. In the embodiment shown in FIG. 1, the driving circuit unit 109 is electrically connected to two rows of pixel units 105 simultaneously, i.e. each pixel circuit of the two rows of pixel units 105 is electrically connected to the driving circuit unit 109 to receive various driving signals transmitted from the driving circuit unit 109 to finally achieve light emitting and display of the pixel circuits.

It is well-known in the prior art that any one of driving circuit units arranged in the non-display area is, generally electrically connected to a row of pixel units in the display area in a corresponding manner. In other words, the row of pixel units depends mainly on the driving circuit units that correspond to them to provide driving signals. Thus, for the organic light emitting display panel, the number of driving circuit units arranged in the non-display area needs to correspond to that of rows of pixel units, which is disadvantageous to narrow borders.

However, through the adoption of the design in the embodiment shown in FIG. 1, any one of driving circuit units 109 is electrically connected to more than two rows of pixel units 105 simultaneously, which can reduce the number of driving circuits in the non-display area 103, and thus is more advantageous to narrow borders.

Figure 2:
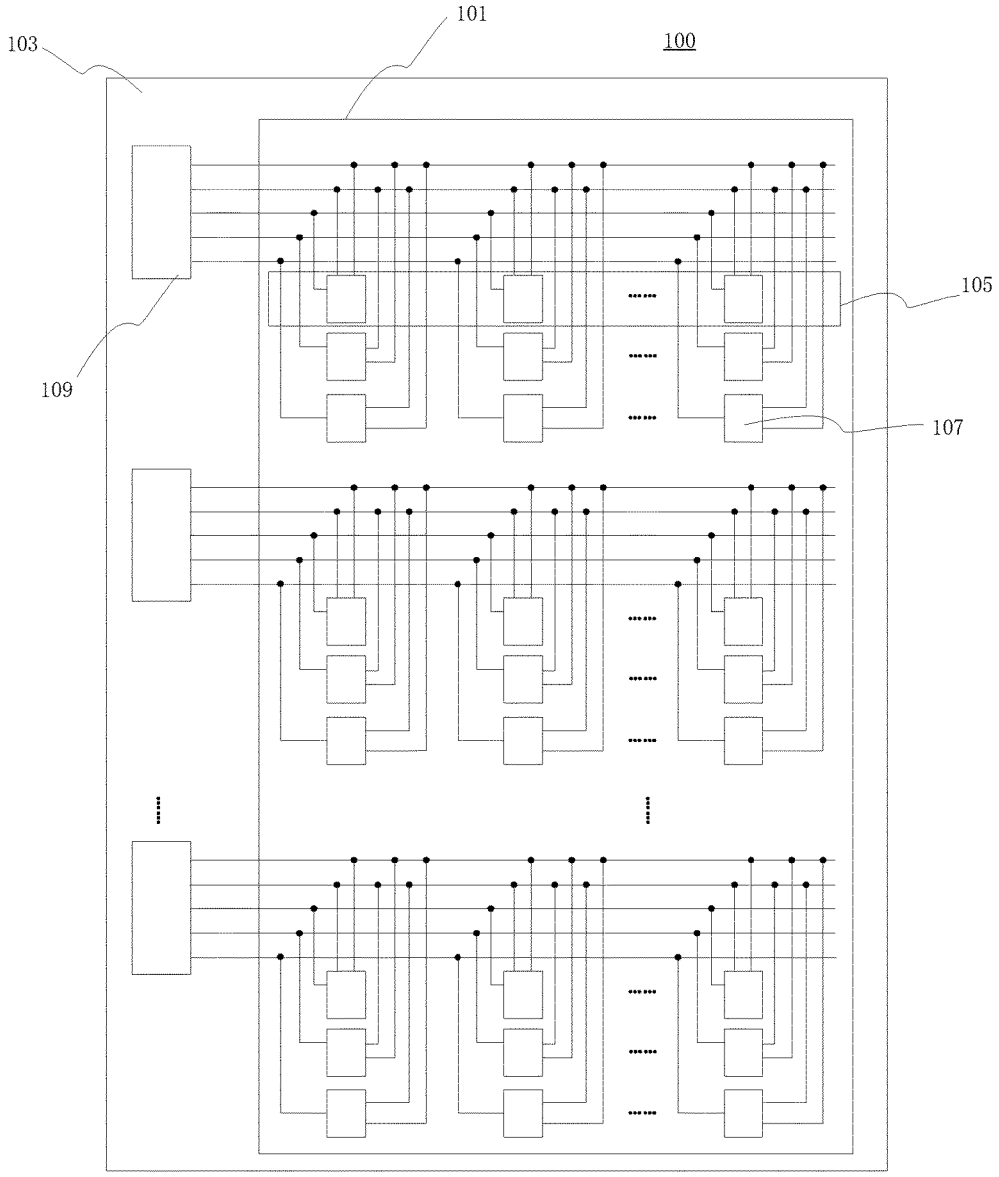
FIG. 2 depicts another exemplary organic light emitting display panel consistent with disclosed embodiments.

It should be noted that, the embodiment shown in FIG. 1 merely schematically shows the driving circuit unit 109 electrically connected to the two rows of pixel units 105 simultaneously, at least one embodiment of the invention is not limited in this respect, and also the driving circuit unit 109 can electrically connected to the three rows of pixel units 105 simultaneously like an organic light emitting display panel shown in FIG. 2, or a driving circuit unit electrically connected to more rows of pixel units simultaneously, which will not be explicitly listed herein.

FIG. 2 depicts another exemplary organic light emitting display panel consistent with disclosed embodiments, the similarity of which will not be described any longer as there are many similarities with the structure of the embodiment shown in FIG. 1. Therefore, only the different designs are explained in detail. In addition, the same numeral references in the embodiment shown in FIG. 1 are also used hereinafter because of a plurality of similar designs.

Particularly, the driving circuit unit 109 includes a first driving circuit 111 and a second driving circuit 113 in the organic light emitting display panel 100, wherein the first driving circuit 111 includes a first scanning signal output circuit 1111 and a light emitting output circuit 1112, and the first scanning signal output circuit 1111 and the light emitting signal output circuit 1112 are electrically connected to more than two rows of pixel units 105 simultaneously. The second driving circuit 113 includes two second scanning signal output circuits 1131/1132, the two second scanning signal output circuits 1131/1132 are electrically connected to the two rows of pixel units 105 respectively in one-to-one correspondence.

Figure 3:
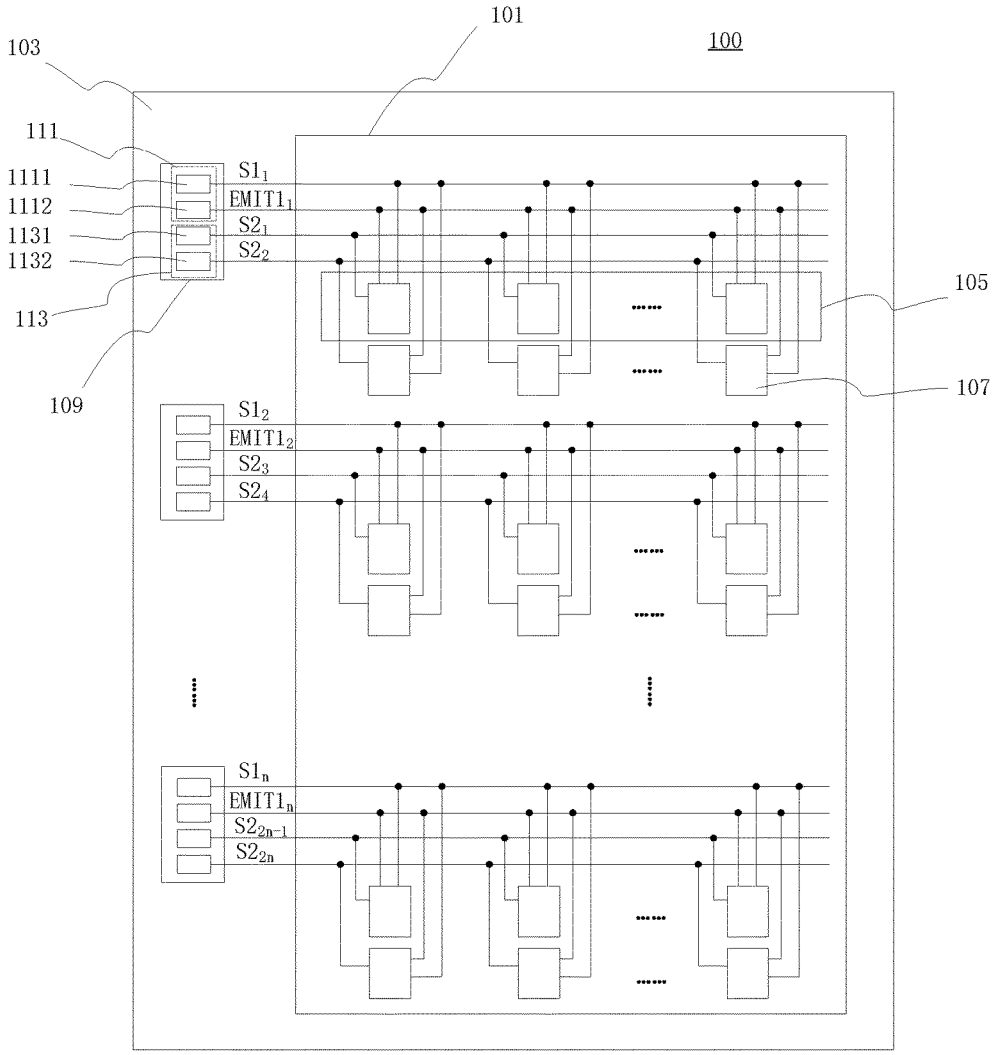
FIG. 3 depicts another exemplary organic light emitting display panel consistent with disclosed embodiments.

It should be noted that, FIG. 3 only takes the second driving circuit 113 including the two second scanning signal output circuits 1131/1132 for example for description, and the two second scanning signal output circuits 1131/1132 are electrically connected to the two rows of pixel units 105 respectively in one-to-one correspondence. Particularly, the number of the second scanning signal output circuit is two, which is not limited and can be more and will not be described in detail.

Wherein, for the entire organic light emitting display panel, the non-display area includes n cascaded driving circuit units, for the first level of driving circuit unit, the first scanning signal output circuit 1111 outputs a first scanning signal S11 to the corresponding two rows of pixel units, the light emitting signal output circuit 1112 outputs a light emitting signal EMIT11 to the corresponding two rows of pixel units, the second scanning signal output circuit 1131 outputs a second scanning signal S21 to the corresponding one row of pixel units, the second scanning signal output circuit 1132 outputs a second scanning signal S22 to the corresponding one row of pixel units; for the second level of driving circuit unit, the first scanning signal output circuit 1111 outputs a first scanning signal S12 to the corresponding two rows of pixel units, the light emitting signal output circuit 1112 outputs a light emitting signal EMIT12 to the corresponding two rows of pixel units, the second scanning signal output circuit 1131 outputs a second scanning signal S23 to the corresponding one row of pixel units, the second scanning signal output circuit 1132 outputs a second scanning signal S24 to the corresponding one row of pixel units; similarly, for the No. n level of driving circuit unit, the first scanning signal output circuit 1111 outputs a first scanning signal S1*n* to the corresponding two rows of pixel units, the light emitting signal output circuit 1112 outputs a light emitting signal EMIT1*n* to the corresponding two rows of pixel units, the second scanning signal output circuit 1131 outputs a second scanning signal S22*n*-1 to the corresponding one row of pixel units, the second scanning signal output circuit 1132 outputs a second scanning signal S22*n* to the corresponding one row of pixel units.

By using the solution in another exemplary organic light emitting display panel consistent with disclosed embodiments shown in FIG. 3, any two rows of pixel units 105 can receive the first scanning signal sent by the first scanning signal output circuit 1111 simultaneously at the stage (for example, the pixel circuit generally includes the initialization stage and/or the threshold compensation stage in the prior art) before the pixel lighting, for example, the two rows of pixel units 105 can first receive the first scanning signal S11 output by the first scanning signal output circuit 1111 at the initialization stage and/or the threshold compensation stage.

Then, at the next stage (for example, which can be the data writing stage mentioned in the prior art), one row of pixel units 105 of the two rows of pixel units 105 can first receive the second scanning signal S21 output by the second scanning signal output circuit 1131, the other row of pixel units 105 of the two rows of pixel units 105 can then receive the second scanning signal S22 output by the second scanning signal output circuit 1132, during which the two rows of pixel units can be turned on and operated respectively (for example, data writing). Then, at the next stage (for example, which can be the light emitting stage mentioned in the prior art), the two rows of pixel circuits 105 can receive the light emitting signal EMIT11 sent by the light emitting signal output circuit 1112, and begin to light.

Compared to the prior art that each row of pixel units needs to be subjected to the initialization stage, the threshold compensation stage, the data writing stage and the light emitting stage respectively, and with the continuous improvement of display resolution, the required time for driving all pixel circuits in each row of pixel units is further compressed, such that the signal input and output at each stage for each row of pixel units cannot be very complete, which leads to abnormal display.

Through adoption of the design as shown in FIG. 3 of the embodiment of at least one embodiment of the invention, signal writing for two or more rows of pixel units can be carried out simultaneously at stages such as the initialization stage and/or the threshold compensation stage and the light emitting stage, and signal writing is successively carried out only at one of the stages (for example, the data writing stage) to leave more scanning time during one frame of scanning time. In the whole scanning process, the threshold compensation stage is particularly important since the saved scanning time can be distributed to the threshold compensation stage, which is conducive to the more accurate threshold compensation.

In addition, through adoption of the design in the embodiment shown in FIG. 3, any one of the driving circuit units 109 is electrically connected to more than two rows of pixel units 105 simultaneously, which can reduce the number of driving circuit units 109 in non-display area 103, and is more conducive to the narrow borders compared with the prior art.

Figure 4:
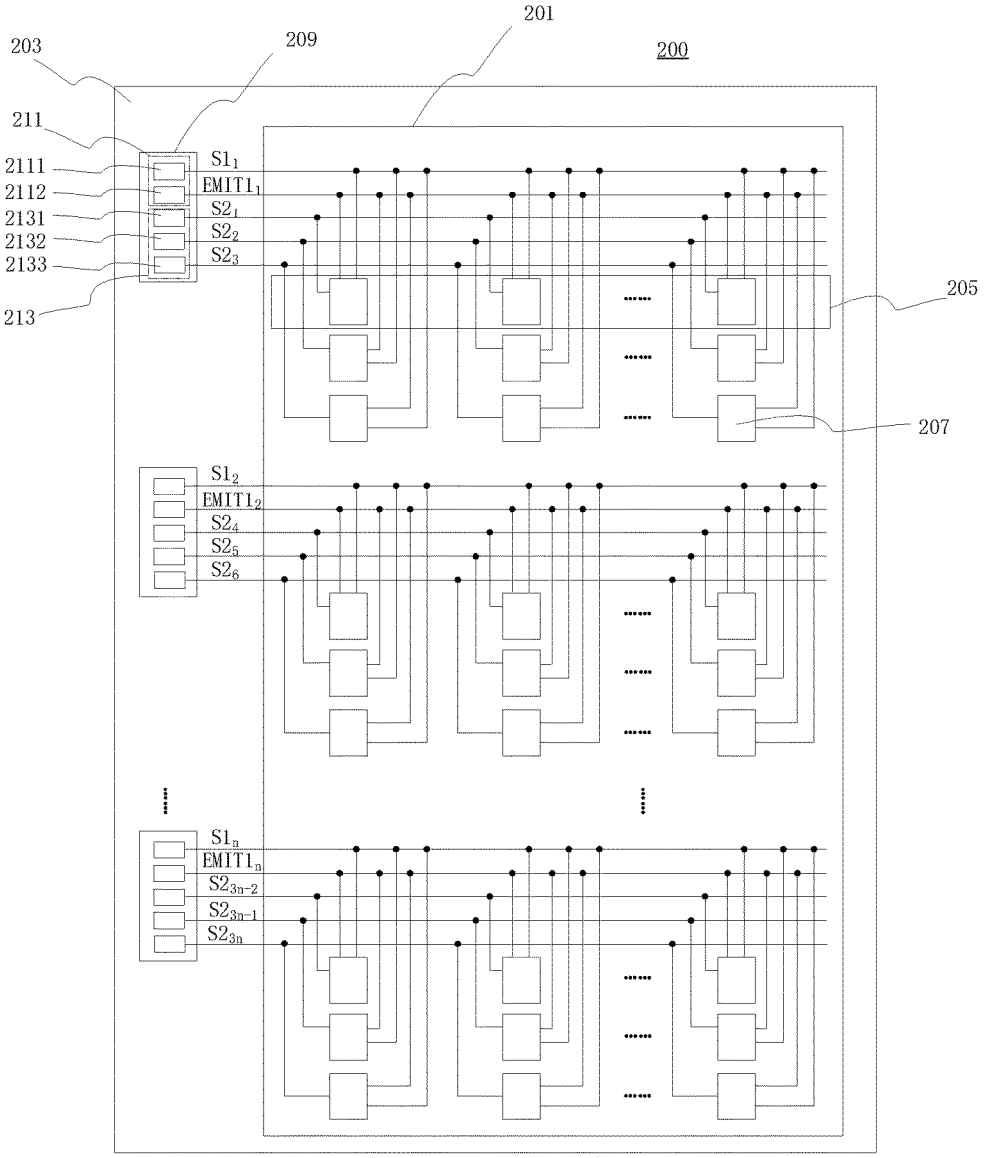
FIG. 4 depicts another exemplary organic light emitting display panel consistent with disclosed embodiments.

FIG. 4 depicts another exemplary organic light emitting display panel 200 consistent with disclosed embodiments, wherein the organic light emitting display panel 200 comprises a display area 201 and a non-display area 203, and the non-display area 203 surrounds the display area 201. The display area 201 includes a plurality of rows of pixel units 205, each row of pixel units 205 includes a plurality of pixel circuits 207, the specific structure of pixel circuits 207 is not defined herein, it can be composed by arbitrary number of transistors, capacitors and light emitting diodes electrically connected to one another, for example, it can be composed by two transistors, one capacitor and one light emitting diode for the simplest form.

The non-display area 203 includes a plurality of driving circuit units 209, any one of the driving circuit units 209 is electrically connected to three rows of pixel units 205 simultaneously, that is, each pixel circuit in the three rows of pixel units 205 is electrically connected to the driving circuit unit 209 to receive various driving signals sent from the driving circuit unit 209 to finally achieve the light emitting and display of the pixel circuit.

Particularly, in the embodiment shown in FIG. 4, the driving circuit unit 209 comprises a first driving circuit 211 and a second driving circuit 213, wherein the first driving circuit 211 comprises a first scanning signal output circuit 2111 and a light emitting signal output circuit 2112, and the first scanning signal output circuit 2111 and the light emitting signal output circuit 2112 are electrically connected to three rows of pixel units 105 simultaneously. The second driving circuit 113 includes three second scanning signal output circuits 2131/2132/2133, and the three second scanning signal output circuits 2131/2132/2133 are electrically connected to three rows of pixel units 205 respectively in one-by-one correspondence.

Wherein, for the entire organic light emitting display panel, the non-display area includes n cascaded driving circuit units, for the first level of driving circuit unit 209, the first scanning signal output circuit 2111 outputs a first scanning signal S11 to corresponding three rows of pixel units, the light emitting signal output circuit 2112 outputs a light emitting signal EMIT11 to corresponding three rows of pixel units, the second scanning signal output circuit 2131 outputs a second scanning signal S21 to corresponding one row of pixel units, the second scanning signal output circuit 2132 outputs a second scanning signal S22 to corresponding one row of pixel units, and the second scanning signal output circuit 2133 outputs a second scanning signal S23 to corresponding one row of pixel units; for the second level of driving circuit unit 209, the first scanning signal output circuit 2111 outputs a first scanning signal S12 to corresponding three rows of pixel units, the light emitting signal output circuit 2112 outputs a light emitting signal EMIT12 to corresponding three rows of pixel units, the second scanning signal output circuit 2131 outputs a second scanning signal S24 to corresponding one row of pixel units, the second scanning signal output circuit 2132 outputs a second scanning signal S25 to corresponding one row of pixel units, and the second scanning signal output circuit 2133 outputs a second scanning signal S26 to corresponding one row of pixel units; similarly, for the No. n level of driving circuit unit, the first scanning signal output circuit 2111 outputs a first scanning signal S1*n* to corresponding three rows of pixel units, the light emitting signal output circuit 2112 outputs a light emitting signal EMIT1*n* to corresponding three rows of pixel units, the second scanning signal output circuit 2131 outputs a second scanning signal S23*n*-2 to corresponding one row of pixel units, the second scanning signal output circuit 2132 outputs a second scanning signal S23*n*-1 to corresponding one row of pixel units, and the second scanning signal output circuit 2133 outputs a second scanning signal S23*n* to corresponding one row of pixel units.

By using the solution in the disclosed embodiment shown in FIG. 4, any three rows of pixel units 105 can receive the first scanning signal sent by the first scanning signal output circuit 2111 simultaneously at the stage (for example, the initialization stage and/or threshold compensation stage generally included in the pixel circuit in the prior art) before the pixel lighting, for example, the three rows of pixel units 205 can receive the first scanning signal S11 sent by the first scanning signal output circuit 1111 simultaneously at the initialization stage and/or the threshold compensation stage; then, at the next stage (for example, which can be data writing stage mentioned in the prior art), one row of pixel units 105 of the three rows of pixel units 205 first receives the second scanning signal S21 output by the second scanning signal output circuit 2131, another row of pixel units 205 of the three rows of pixel units 105 then receives the second scanning signal S22 output by the second scanning signal output circuit 2132, another row of pixel units 205 of the three rows of pixel units 205 then receive the second scanning signal S23 output by the second scanning signal output circuit 2133, three rows of pixel units can be turned on and operated (for example, data writing) respectively during this process; then, at the next stage (for example, which can be the light emitting stage mentioned in the prior art), the three rows of pixel circuits 205 receive the light emitting signal EMIT11 sent by the light emitting signal output circuit 1112, and begin to light.

Compared to the prior art that each row of pixel units needs to be subjected to the initialization stage, the threshold compensation stage, the data writing stage and the light emitting stage, and with the continuous improvement of display resolution, the required time for driving all pixel circuits of each row of pixel units is further compressed, which leads to abnormal display. Through adoption of the design as shown in FIG. 4 of at least one embodiment of the invention, signal writing for three or more rows of pixel units can be carried out simultaneously at stages such as the initialization stage and/or the threshold compensation stage and the light emitting stage, and signal writing is successively carried out only at one of the stages (for example, the data writing stage) to leave more scanning time during one frame of scanning time.

In the whole scanning process, the threshold compensation stage is particularly important since the saved scanning time can be distributed to the threshold compensation stage, which is conducive to the more accurate threshold compensation. In addition, through adoption of the design in the embodiment shown in FIG. 4, any one of the driving circuit units 209 is electrically connected to three or more rows of pixel units 205 simultaneously, which can reduce the number of driving circuit unit 209 in non-display area 203, and is more conducive to the narrow border compared with the prior art.

Figure 5:
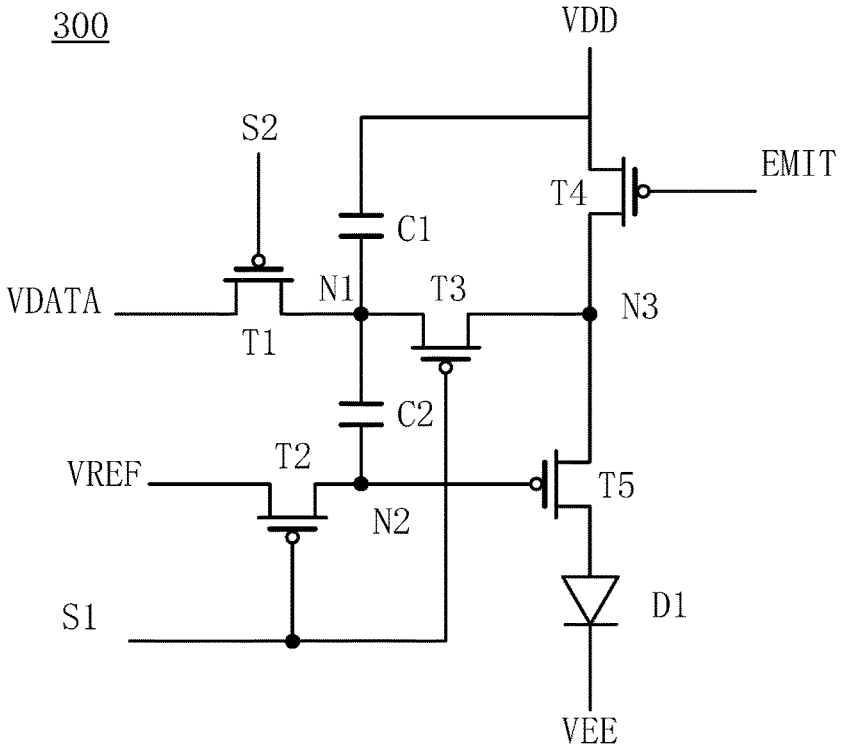
FIG. 5 depicts an exemplary pixel circuit provided consistent with disclosed embodiments.

The organic light emitting display panel provided by at least one embodiment of the present invention is further described below in conjunction with a pixel circuit. FIG. 5 depicts an exemplary pixel circuit 300 consistent with disclosed embodiments. The pixel circuit 300 has an arrangement relation in the organic light emitting display panel the same as those indicated by pixel circuits 205 in at least one embodiment of the invention shown in FIGS. 1-4, and receives signals from a first scanning signal output circuit, a second scanning signal output circuit and a light emitting signal output circuit of a driving circuit unit in the non-display area.

Particularly, the pixel circuit 300 comprises a first transistor T1, a second transistor T2, a third transistor T3, a fourth transistor T4, a fifth transistor T5, a first capacitor C1, a second capacitor C2 and a light emitting diode D1. A gate electrode of the first transistor T1 is electrically connected to the second scanning signal output circuit S2, a first electrode of the first transistor T1 receives a data signal VDATA, and a second electrode of the first transistor T1 is electrically connected to a first electrode of the third transistor T3; a gate electrode of the second transistor T2 is electrically connected to the first scanning signal output circuit S1, a first electrode of the second transistor T2 receives a reference signal VREF, and a second electrode of the second transistor T2 is electrically connected to a gate electrode of the fifth transistor T5; a gate electrode of the third transistor T3 is electrically connected to the first scanning signal output circuit S1, and a second electrode of the third transistor T3 is electrically connected to a second electrode of the fourth transistor T4; a gate electrode of the fourth transistor T4 is electrically connected to the light emitting signal output circuit EMIT, and a first electrode of the fourth transistor T4 receives a first power voltage signal VDD; a first electrode of the fifth transistor T5 is electrically connected to the second electrode of the fourth transistor T4, and a second electrode of the fifth transistor T5 is electrically connected to a positive of the light emitting diode D1; a negative of the light emitting diode D1 receives a second power voltage signal VEE; a first polar plate of the first capacitor C1 is electrically connected to the first electrode of the fourth transistor T4, and a second polar plate of the first capacitor C1 is electrically connected to the second electrode of the first transistor T1; a first polar plate of the second capacitor C2 is electrically connected to the second electrode of the first transistor T1, and a second polar plate of the second capacitor C2 is electrically connected to the second electrode of the second transistor T2.

Wherein, the electric connection node between the second polar plate of the first capacitor C1 and the first polar plate of the second capacitor C2 is a first node N1, the electric connection node between the second polar plate of the second capacitor C2 and the second electrode of the second transistor T2 is a second node N2, and the electric connection node between the first electrode of the fifth transistor T5 and the second electrode of the fourth transistor T4 is a third node N3.

Wherein, for the disclosed embodiment shown in FIG. 5, the transistors in the pixel circuit 300 are all P-type transistors or N-type transistors.

Additionally, for at least one embodiment of the invention shown in FIG. 5, the data signal VDATA, the reference signal VREF, the first power voltage signal VDD and the second power voltage signal VEE in the pixel circuit 300 are all provided by an integrated driving circuit located in the non-display area. This will not be described in further detail and will be omitted from the organic light emitting display panel shown in FIGS. 1-4 as it belongs to the technical information known to those skilled in the art.

Figure 6:
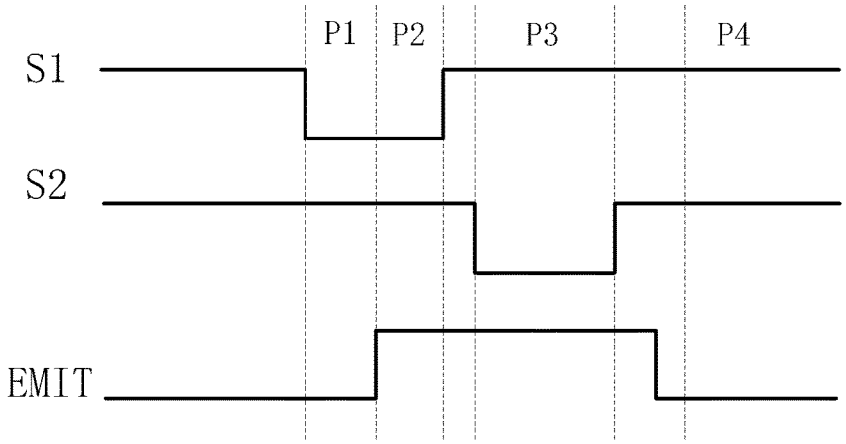
FIG. 6 depicts an exemplary driving timing diagram for driving the pixel circuit shown in FIG. 5.

FIG. 6 depicts an exemplary driving timing diagram for pixel circuits, and specifically, a driving timing diagram for driving the pixel circuit in FIG. 5. The driving timing diagram shown in FIG. 6 comprises four stages: an initialization stage P1, a threshold compensation stage P2, a data writing stage P3 and a light emitting stage P4. Taking all the transistors in the pixel circuit as P-type ones for example, particularly in the initialization stage P1, the first scanning signal S1 is a low level signal, the second scanning signal S2 is a high level signal, the light emitting signal EMIT is a low level signal, the second transistor T2, the third transistor T3 and the fourth transistor T4 are turned on, the voltage of the second node N2 is VN2=VREF, and the voltages of the first node N1 and the third node N3 are VN1=VN3=VDD; consequently, the initialization of each of the nodes is achieved in the initialization stage P1.

In the threshold compensation stage P2, the first scanning signal S1 is a low level signal, the second scanning signal S2 is a high level signal, the light emitting signal EMIT is a high level signal, and the second transistor T2 and the third transistor T3 are turned on; moreover, due to the on-off characteristics of transistors, the fifth transistor T5 is changed gradually from turning-on to turning-off, and when the fifth transistor T5 is turned off, the voltages of the first node N1 and the third node N3 are fixed to be VN1=VN3=VREF+Vth (Vth is the threshold voltage of the fifth transistor T5); consequently, the capturing of threshold values for the nodes is achieved in the threshold compensation stage P2.

In the data writing stage P3, the first scanning signal S1 is a high level signal, the second scanning signal S2 is a low level signal, the light emitting signal EMIT is a high level signal, and the voltage of the first node N1 is VN1=VDATA; moreover, due to the coupling effect of the second capacitor C2, the voltage of the second node N2 is VN2=VDATA+Vth; consequently, the writing of the data signal VDATA is completed in the data writing stage P3.

In the light emitting stage P4, the first scanning signal S1 is a high level signal, the second scanning signal S2 is a high level signal, the light emitting signal EMIT is a low level signal, the fourth transistor T4 and the fifth transistor T5 are turned on, and the current flowing through the light emitting diode D1 is $IOLED=K\ (Vgs-Vth)^2=K\ (VDATA-VDD)^2$; consequently, the light emitting of the light emitting diode is achieved in the light emitting stage P4; moreover, as the final current flowing through the light emitting diode D1 is independent of the threshold voltage Vth of the fifth transistor, the threshold compensation is achieved, and thus the entire display panel displays more uniformly.

Furthermore, at least one embodiment of the present invention also provides a driving method for driving the organic light emitting display panel as shown in the foregoing embodiment, comprising: driving of any one of pixel circuits all includes at least the processes of initialization, threshold compensation, data writing and light emitting, and the data writing is carried out successively after simultaneous initialization and/or threshold compensation of two or more rows of pixel units.

Particularly, referring to the embodiment shown in FIG. 3 or FIG. 4, the first scanning signal output circuits 1111/2111 and/or the light emitting signal output circuits 1112/2112 simultaneously transmit the first scanning signal S11 to two or more rows of pixel units 105/205 in one-to-one correspondence; however, more than two of the second scanning signal output circuits 1131/1132/2131/2132 successively transmit the second scanning signal to the foregoing more than two rows of pixel units 105/205.

In conjunction with FIGS. 5-6 and 1-4, for at least one embodiment of the present invention shown in FIGS. 1-4, when a certain driving circuit unit 109/209 in the non-display area of the organic light emitting display panel inputs an effective first scanning signal S1 (namely, when the first scanning signal S1 is a low level signal), the pixel circuits in two rows, three rows or more rows of pixel units corresponding to the driving circuit in the entire display area of the organic light emitting display panel will be simultaneously subjected to initialization (i.e. simultaneously enter the initialization stage) and/or threshold compensation (i.e. simultaneously enter the threshold compensation stage.

It should be noted that for some pixel circuits, initialization is not necessary and threshold compensation can be carried out directly; this will not be described herein in further detail, and only pixel circuits comprising the initialization stage are illustrated). Although pixel circuits 107/207 in a plurality of rows of pixel units 105/205 are subjected to initialization and threshold compensation simultaneously, signal interference does not exist between them.

However, according to the design of at least one embodiment of the present invention, each row of pixel units needs to be individually and successively subjected to data writing (i.e. more than two of the second scanning signal output circuits transmit the second scanning signals to more than two rows of pixel units and more than two rows of pixel units successively enter the data writing stage, thus achieving different data signals written at different time), while pixel circuits in the pixel units which are not designed as two rows, three rows or more rows are connected to the same second scanning signal output circuits (i.e. data signals are written simultaneously).

This is because if data writing is carried out simultaneously for pixel circuits in two rows, three rows or more rows of pixel units, different data is written for each row compared with the prior art, thus leading to reduction in the resolution of the organic light emitting display panel. Additionally, for at least one embodiment of the present invention, the reason for data writing carried out successively after simultaneous initialization and/or threshold compensation more than two rows of the pixel units, instead of design for a time period for the joint performing of the data writing stage and the initialization stage and/or the threshold compensation stage (or carried out in a completely simultaneous manner) is that at least one embodiment of the present invention comprise two rows, three rows or more rows of pixel units and two, three or more second scanning signal output circuits corresponding to them; if there exists an overlapping time frame between an effective second scanning signal (e.g., the time frame in FIG. 6 during which S2 is a low level signal) output by one of the second scanning signal output circuits and an effective first scanning signal (e.g., the time frame in FIG. 6 during which S1 is a low level signal) output by a first scanning signal output circuit, there must be an overlapping time frame between an effective second scanning signal output by the other or other second scanning signal output circuits and the effective first scanning signal output by the first scanning signal output circuit according to the signal transmission principle of the driving circuit unit. Thus, the second scanning signals output by two, three or more second scanning signal output circuits will also have overlapping as for time (i.e. there exists a time frame for the joint inputting of effective low level).

In this manner, in the display area of the organic light emitting display panel, there will be a time frame during which different data signals are written simultaneously for two rows, three rows or more rows of pixel units and the different data signals input during this overlapping time frame will influence each other, and thus data signals cannot be written accurately. Therefore, adoption of the organic light emitting display panel provided by at least one embodiment of the present invention can be more advantageous to narrow borders on the basis of ensuring resolution and avoiding abnormal image display.

It should be noted that the pixel circuit provided by at least one embodiment of the invention shown in FIG. 5 and the driving timing diagram shown in FIG. 6 for driving the pixel circuit of FIG. 5 are only used for describing the operating principle in conjunction with the embodiments given in FIG. 1 to FIG. 4, the structure and the driving method of the pixel circuit of the organic light emitting display panel will not be defined herein, which will not be described in detail, and it will be enough to ensure that any pixel circuit should at least include processes of initialization, threshold compensation, data writing and light emitting, and data writing is successively carried out after more than two rows of pixel unit simultaneously subjected to the initialization and/or threshold compensation.

It also should be noted that the "first scanning signal", "second scanning signal" and "light emitting signal" among the "sending the first scanning signal", "sending the second scanning signal" and "sending the light emitting signal" all refer to valid signals, taking the driving timing diagram as shown in FIG. 6 for example, the valid signals refer to: when the transistors of the entire pixel circuit are all P-type transistors, the "first scanning signal" in the "sending the first scanning signal" is a low level signal, because that although the driving circuit is actually always at the state sending signal, the transistors can only be turned on by using the low-level signal for the transistors in the pixel circuit, and some functions, such as initialization, threshold compensation, signal writing and so on, can be carried out.

Moreover, at least one embodiment of the present invention also provides an organic light emitting display device, the specific structure of the organic light emitting display device includes the organic light emitting display panel shown in FIG. 1 to FIG. 4, and the specific structure will not be described in detail herein, and the organic light emitting display device can be display devices, such as cell phones, computers, tablet computers, onboard display devices and so on.

It should be noted that the contents described above are only some embodiments of the invention and the technical principle thereof. It should be understood by one skilled in the art that at least one embodiment of the present invention should not be limited to the specific embodiments described herein, and obvious variations, re-adjustments and replacements without departing from the protection scope of at least one embodiment of the present invention will be apparent to those skilled in the art.

Therefore, although at least one embodiment of the present invention was described in detail using the embodiments mentioned above, at least one embodiment of the present invention is not only limited to the embodiments mentioned above, at least one embodiment of the present invention can also include other equivalent embodiments without departing from the concept of at least one embodiment of the present invention, and the scope of at least one embodiment of the present invention is determined by the appended claims.

What is claimed is:

1. An organic light emitting display panel comprising:

a display area; and a non-display area surrounding the display area, wherein the display area includes a plurality of rows of pixel units, and each row of the plurality of rows of the pixel units includes a plurality of pixel circuits;

a plurality of cascaded driving circuit units are located in the non-display area, wherein each driving circuit of the plurality of cascaded driving circuit units comprises a first driving circuit and a second driving circuit; and any one driving circuit unit of the plurality of cascaded driving circuit units is electrically connected to more than two rows of the plurality of rows of the pixel units simultaneously, wherein:

the first driving circuit includes a light emitting signal output circuit and a first scanning signal output circuit, the light emitting signal output circuit and the first scanning signal output circuit are electrically connected to the more than two rows of the plurality of rows of pixel units simultaneously; and the second driving circuit includes more than two second scanning signal output circuits, the more than two second scanning signal output circuits are electrically connected to the more than two rows of the plurality of rows of pixel units respectively in one-to-one correspondence.

2. The organic light emitting display panel of claim 1, wherein any one of the plurality of cascaded driving circuit units is electrically connected to three rows of the plurality of rows of pixel units simultaneously.

3. The organic light emitting display panel of claim 1, wherein each pixel circuit of the plurality of pixel circuits comprises a first transistor, a second transistor, a third transistor, a fourth transistor, a fifth transistor, a first capacitor, a second capacitor and a light emitting diode, wherein:

a gate electrode of the first transistor is electrically connected to the second scanning signal output circuits, a first electrode of the first transistor is configured to receive a data signal, and a second electrode of the first transistor is electrically connected to a first electrode of the third transistor;

a gate electrode of the second transistor is electrically connected to the first scanning signal output circuit, a first electrode of the second transistor is configured to receive a reference signal, and a second electrode of the second transistor is electrically connected to a gate electrode of the fifth transistor;

a gate electrode of the third transistors is electrically connected to the first scanning signal output circuit, and a second electrode of the third transistors is electrically connected to a second electrode of the fourth transistor;

a gate electrode of the fourth transistor is electrically connected to the light emitting signal output circuit, and a first electrode of the fourth transistor is configured to receive a first power voltage signal;

a first electrode of the fifth transistor are electrically connected to the second electrode of the fourth transistor, and a second electrode of the fifth transistor is electrically connected to a positive of the light emitting diode;

a negative of the light emitting diode is configured to receive a second power voltage signal;

a first plate of the first capacitor is electrically connected to the first electrode of the fourth transistor, and a second plate of the first capacitor is electrically connected to the second electrode of the first transistor;

a first plate of the second capacitor is electrically connected to the second electrode of the first transistor, and a second plate of the second capacitor is electrically connected to the second electrode of the second transistor.

4. The organic light emitting display panel of claim 3, wherein the first transistor, the second transistor, the third transistor, the fourth transistor and the fifth transistor are P-type transistors; or the first transistor, the second transistor, the third transistor, the fourth transistor and the fifth transistor are N-type transistors.

5. The organic light emitting display panel of claim 3, further comprising an integrated driving circuit configured to provide the data signal, the reference signal, the first power voltage signal and the second power voltage signal, wherein the integrated driving circuit is located in the non-display area.

6. A driving method of driving an organic light emitting display panel comprising a display area; and a non-display area surrounding the display area, wherein the display area includes a plurality of rows of pixel units, and each row of the plurality of rows of the pixel units includes a plurality of pixel circuits; a plurality of cascaded driving circuit units are located in the non-display area, wherein each driving circuit of the plurality of cascaded driving circuit units comprises a first driving circuit and a second driving circuit; and any one driving circuit unit of the plurality of cascaded driving circuit units is electrically connected to more than two rows of the plurality of rows of the pixel units simultaneously, wherein:

the first driving circuit includes a light emitting signal output circuit and a first scanning signal output circuit, the light emitting signal output circuit and the first scanning signal output circuit are electrically connected to the more than two rows of the plurality of rows of pixel units simultaneously; and the second driving circuit includes more than two second scanning signal output circuits, the more than two second scanning signal output circuits are electrically connected to the more than two rows of the plurality of rows of pixel units respectively in one-to-one correspondence, the method comprising:

driving any one of the plurality of pixel circuits at least by processes of an initialization, a threshold compensation, a data writing and a light emitting;

simultaneously performing at least one of the initialization and the threshold compensation to the more than two rows of the plurality of rows of pixel units; and successively performing the data writing.

7. The driving method for driving the organic light emitting display panel of claim 6, further comprising:

simultaneously transmitting a first scanning signal to the more than two rows of the plurality of rows of pixel units from the first scanning signal output circuit or the light emitting signal output circuit in one-to-one correspondence; and successively transmitting a second scanning signal to the more than two rows of the plurality of rows of pixel units from more than two of the second scanning signal output circuits.

8. The driving method for driving the organic light emitting display panel of claim 6, wherein: any one of the plurality of cascaded driving circuit units is electrically connected to three rows of the plurality of rows of pixel units simultaneously.

9. The driving method for driving the organic light emitting display panel of claim 6, wherein each pixel circuit of the plurality of pixel circuits comprises a first transistor, a second transistor, a third transistor, a fourth transistor, a fifth transistor, a first capacitor, a second capacitor and a light emitting diode, wherein:

a gate electrode of the first transistor is electrically connected to the second scanning signal output circuits, a first electrode of the first transistor is configured to receive a data signal, and a second electrode of the first transistor is electrically connected to a first electrode of the third transistor;

a gate electrode of the second transistor is electrically connected to the first scanning signal output circuit, a first electrode of the second transistor is configured to receive a reference signal, and a second electrode of the second transistor is electrically connected to a gate electrode of the fifth transistor;

a gate electrode of the third transistors is electrically connected to the first scanning signal output circuit, and a second electrode of the third transistors is electrically connected to a second electrode of the fourth transistor;

a gate electrode of the fourth transistor is electrically connected to the light emitting signal output circuit, and a first electrode of the fourth transistor is configured to receive a first power voltage signal;

a first electrode of the fifth transistor are electrically connected to the second electrode of the fourth transistor, and a second electrode of the fifth transistor is electrically connected to a positive of the light emitting diode;

a negative of the light emitting diode is configured to receive a second power voltage signal;

a first plate of the first capacitor is electrically connected to the first electrode of the fourth transistor, and a second plate of the first capacitor is electrically connected to the second electrode of the first transistor;

a first plate of the second capacitor is electrically connected to the second electrode of the first transistor, and a second plate of the second capacitor is electrically connected to the second electrode of the second transistor.

10. An organic light emitting display device comprising the organic light emitting display panel, wherein the organic light emitting display panel comprises:

a display area; and a non-display area surrounding the display area, wherein the display area includes a plurality of rows of pixel units, and each row of the plurality of rows of the pixel units includes a plurality of pixel circuits;

a plurality of cascaded driving circuit units are located in the non-display area, wherein each driving circuit of the plurality of cascaded driving circuit units comprises a first driving circuit and a second driving circuit; and any one driving circuit unit of the plurality of cascaded driving circuit units is electrically connected to more than two rows of the plurality of rows of the pixel units simultaneously, wherein:

the first driving circuit includes a light emitting signal output circuit and a first scanning signal output circuit, the light emitting signal output circuit and the first scanning signal output circuit are electrically connected to the more than two rows of the plurality of rows of pixel units simultaneously; and the second driving circuit includes more than two second scanning signal output circuits, the more than two second scanning signal output circuits are electrically connected to the more than two rows of the plurality of rows of pixel units respectively in one-to-one correspondence.

11. The organic light emitting display device of claim 10, wherein any one of the plurality of cascaded driving circuit units is electrically connected to three rows of the plurality of rows of pixel units simultaneously.

12. The organic light emitting display device of claim 10, wherein each pixel circuit of the plurality of pixel circuits comprises a first transistor, a second transistor, a third transistor, a fourth transistor, a fifth transistor, a first capacitor, a second capacitor and a light emitting diode, wherein:

a gate electrode of the first transistor is electrically connected to the second scanning signal output circuits, a first electrode of the first transistor is configured to receive a data signal, and a second electrode of the first transistor is electrically connected to a first electrode of the third transistor;

a gate electrode of the second transistor is electrically connected to the first scanning signal output circuit, a first electrode of the second transistor is configured to receive a reference signal, and a second electrode of the second transistor is electrically connected to a gate electrode of the fifth transistor;

a gate electrode of the third transistors is electrically connected to the first scanning signal output circuit, and a second electrode of the third transistors is electrically connected to a second electrode of the fourth transistor;

a gate electrode of the fourth transistor is electrically connected to the light emitting signal output circuit, and a first electrode of the fourth transistor is configured to receive a first power voltage signal;

a first electrode of the fifth transistor are electrically connected to the second electrode of the fourth transistor, and a second electrode of the fifth transistor is electrically connected to a positive of the light emitting diode;

a negative of the light emitting diode is configured to receive a second power voltage signal;

a first plate of the first capacitor is electrically connected to the first electrode of the fourth transistor, and a second plate of the first capacitor is electrically connected to the second electrode of the first transistor;

a first plate of the second capacitor is electrically connected to the second electrode of the first transistor, and a second plate of the second capacitor is electrically connected to the second electrode of the second transistor.

13. The organic light emitting display device of claim 12, wherein the first transistor, the second transistor, the third transistor, the fourth transistor and the fifth transistor are P-type transistors; or the first transistor, the second transistor, the third transistor, the fourth transistor and the fifth transistor are N-type transistors.

14. The organic light emitting display device of claim 12, further comprising an integrated driving circuit configured to provide the data signal, the reference signal, the first power voltage signal and the second power voltage signal, wherein the integrated driving circuit is located in the non-display area.

* * * * *